US007160166B2

(12) United States Patent
Humphreys

(10) Patent No.: US 7,160,166 B2
(45) Date of Patent: Jan. 9, 2007

(54) UNDERWATER FLOTATION SAFETY DEVICE

(76) Inventor: Thomas A. Humphreys, 5204 50th St., Apt. E200, Lubbock, TX (US) 79414

( * ) Notice: Subject to any disclaimer, the term of this patent is extended or adjusted under 35 U.S.C. 154(b) by 0 days.

(21) Appl. No.: 11/114,421

(22) Filed: Apr. 26, 2005

(65) Prior Publication Data

US 2006/0240724 A1 Oct. 26, 2006

(51) Int. Cl.
*B63C 9/00* (2006.01)
*B63B 22/08* (2006.01)

(52) U.S. Cl. ..... 441/80; 4/504; 441/11

(58) Field of Classification Search ..... 441/80, 441/2, 11, 7; 4/504; 114/322–329
See application file for complete search history.

(56) References Cited

U.S. PATENT DOCUMENTS

| | | | | |
|---|---|---|---|---|
| 876,777 | A * | 1/1908 | Demptser | 114/325 |
| 913,617 | A | 2/1909 | Busch | |
| 3,036,296 | A * | 5/1962 | Conte | 340/565 |
| 4,187,502 | A * | 2/1980 | Beverly et al. | 340/566 |
| 4,549,871 | A | 10/1985 | Verney | |
| 4,560,356 | A | 12/1985 | Burr | |
| 5,022,013 | A | 6/1991 | Dalton et al. | |
| 5,030,152 | A | 7/1991 | Carr et al. | |
| 5,823,840 | A | 10/1998 | Powers | |
| 6,064,309 | A | 5/2000 | Sellers et al. | |
| 2004/0113836 | A1 | 6/2004 | Rickerson, Jr. | |
| 2004/0121782 | A1 | 6/2004 | Tester | |

* cited by examiner

*Primary Examiner*—Sherman Basinger
(74) *Attorney, Agent, or Firm*—Dale J. Ream

(57) ABSTRACT

An underwater flotation safety device includes a base that may be positioned below the water surface of a swimming pool with ballast, a hook, or the like. A buoyant member is releasably coupled to the base and is also positioned below the water surface. A release member is positioned within a channel defined by the base for selectively releasing the buoyant member from the base. A transmitter is connected to the buoyant member for selectively transmitting a sing. A sensor for detecting a release of the buoyant member from the base is in communication with the transmitter for sending a signal when the buoyant member is released. An alarm unit remote from the transmitter includes a receiver for receiving the signal indicative of a release of the buoyant member. The alarm unit includes another transmitter for transmitting an emergency signal indicative of an emergency condition.

17 Claims, 6 Drawing Sheets

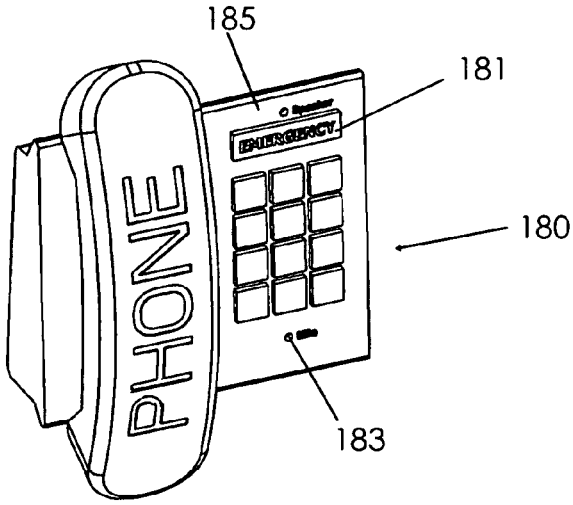
Fig.1B
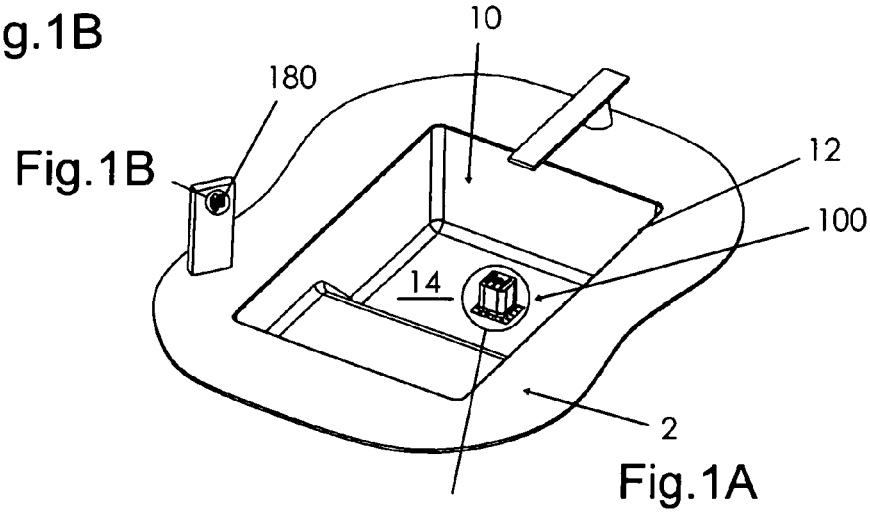
Fig.1B
Fig.1A
Fig.1C
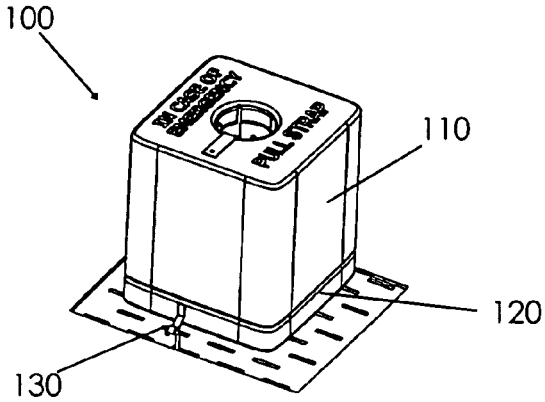
Fig.1C

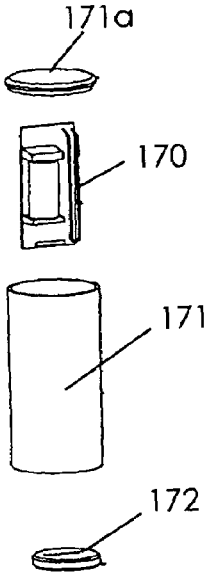
Fig.3B
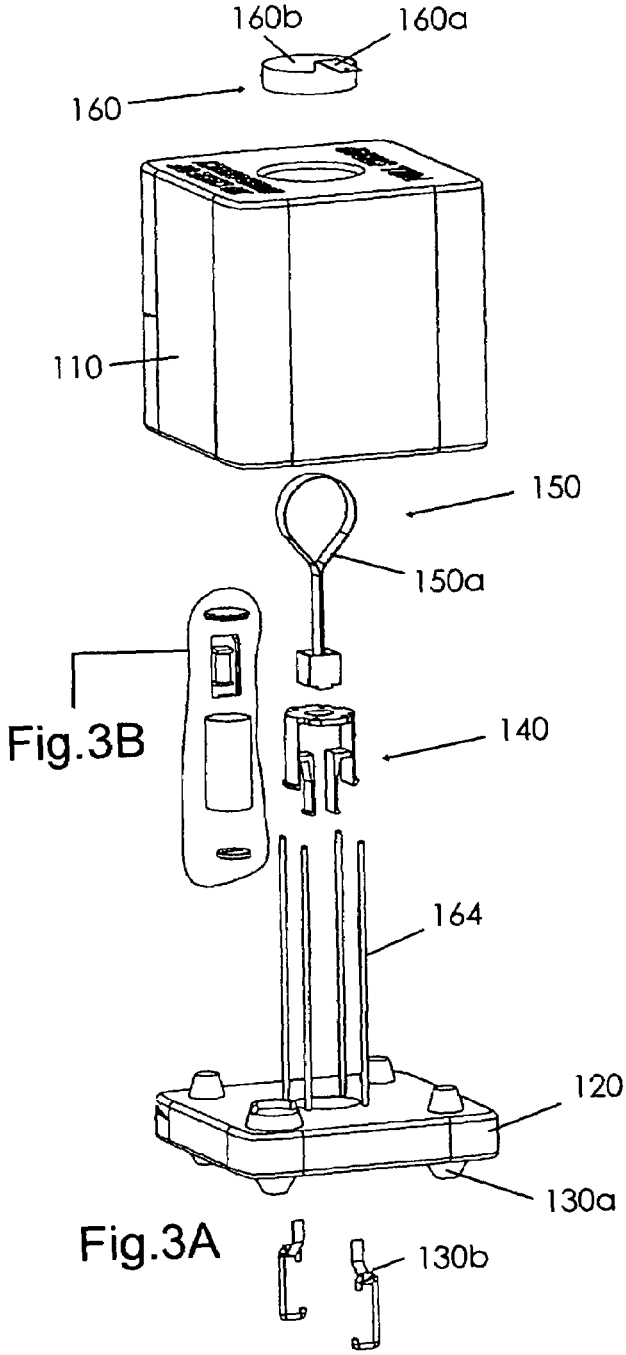
Fig.3B
Fig.3A

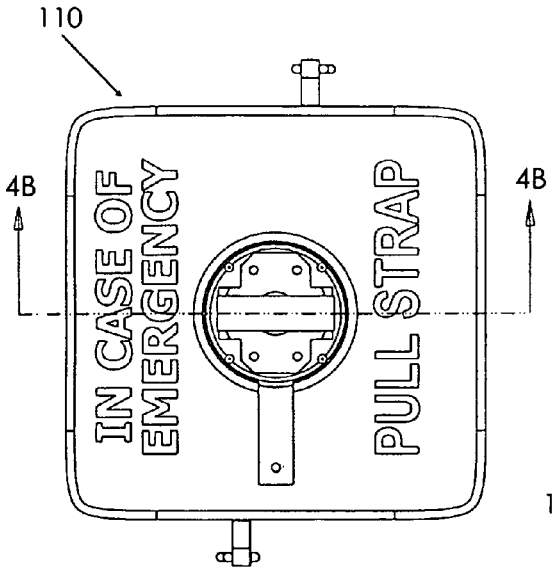
Fig.4A
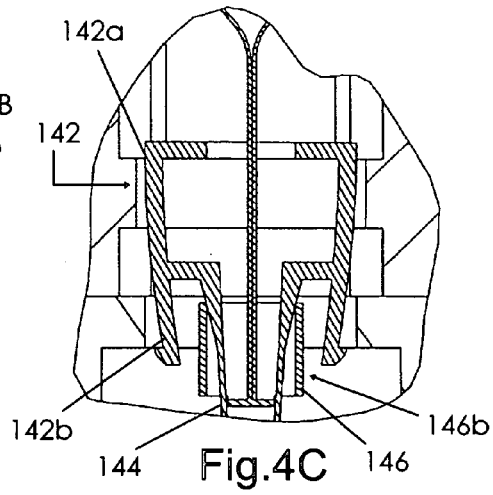
Fig.4C
Disengaged Latch
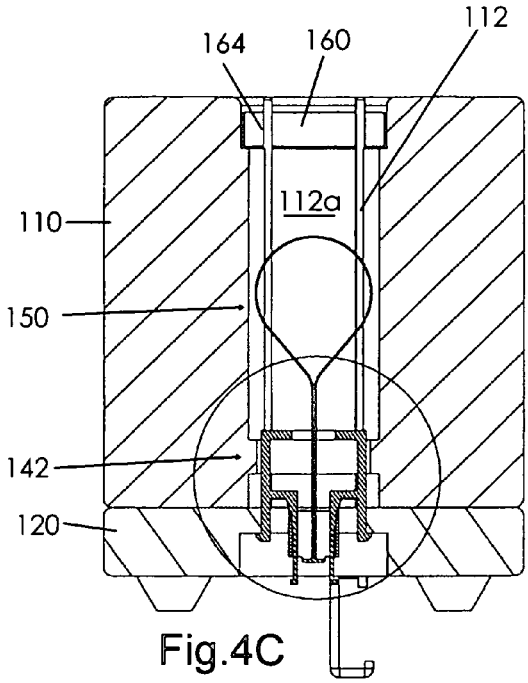
Fig.4C
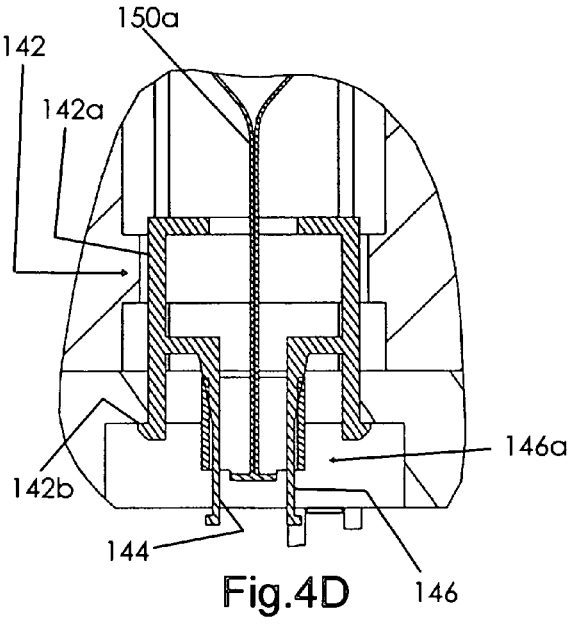
Fig.4D
Engaged Latch
Fig.4B

UNDERWATER FLOTATION SAFETY DEVICE

BACKGROUND AND SUMMARY OF THE INVENTION

This invention relates generally to a water safety device. In particular, the present invention relates to a flotation safety device housed underwater.

In the United States alone, approximately 350 children under five years old drown in pools each year. Among unintentional injuries, drowning is the second leading cause of death for this age group, and another 2,600 children are treated in hospital emergency rooms each year for near-drowning incidents. Furthermore, adults also drown and become injured annually in pools.

In response to this, many different water safety (flotation) devices are found in the art, such as in U.S. Pat. Nos. 913,617, 4,549,871, 4,560,356, 5,030,152, and 5,823,840, and various monitoring and tracking systems have been devised, such as those disclosed in U.S. Pat. No. 6,064,309, U.S. Pat. App. Pub. No. 2004/0121782, and U.S. Pat. App. Pub. No. 2004/0113836. While assumably effective for their intended purposes, the existing devices do not provide a flotation device that is housed underwater to assist a struggling person and that automatically alerts an emergency contact and activates a remote alarm. It would be desirable to have a safety device having these features in order to prevent or minimize injuries and to save lives.

SUMMARY OF THE INVENTION

A safety device according to the present invention includes a base that may be positioned under the water surface of a swimming pool or other body of water by utilizing ballast, a hook for fastening the base to a pool floor, or other similar fastening mechanism. The safety device further includes a buoyant member selectively and releasably attached to the base and adapted to also be positioned below the water surface. The safety device further includes a transmitter in communication with a sensor that is able to detect when the buoyant member is released from the base. Accordingly, the transmitter transmits a signal through the air when actuated by the sensor. An alarm unit remote from the base and transmitter includes a receiver for receiving the signal. Further, the alarm unit includes another transmitter capable of transmitting an emergency signal upon receiving a signal from the base transmitter.

The buoyant member is releasably attached to the base with a coupling that may be manipulated by a person. More particularly, the coupling includes a pair of attachment members and a compression collar. A release strap is connected to the compression collar for selectively causing the collar to bear against the compression arms and to thereby release the buoyant member from the base.

Accordingly, a swimmer who is in distress in the pool may dive to the safety device and pull the release strap. This action causes the buoyant member to be released so as to pull the swimmer quickly to the water surface. Simultaneously, the sensor detects the separation between the buoyant member and base and actuates the transmitter so as to signal the remote alarm unit to summon aid.

Therefore, a general object of this invention is to provide a safety device that is housed underwater when not in use.

Another object of this invention is to provide a safety device, as aforesaid, that is easy to use.

Still another object of this invention is to provide a safety device, as aforesaid, that has a buoyant member releasably attached to a base in a manner that allows the buoyant member to be quickly and easily detached from the base.

Yet another object of this invention is to provide a safety device, as aforesaid, that automatically alerts an emergency contact and activates a remote alarm.

A further object of this invention is to provide a safety device, as aforesaid, that is reliable and requires minimal maintenance.

Other objects and advantages of this invention will become apparent from the following description taken in connection with the accompanying drawings, wherein is set forth by way of illustration and example, embodiments of this invention.

BRIEF DESCRIPTION OF THE DRAWINGS

FIG. 1A is a perspective view of a safety device according a preferred embodiment of the present invention positioned in a swimming pool environment;

FIG. 1B is a perspective view of an alarm unit taken from FIG. 1A and shown on an enlarged scale;

FIG. 1C is a perspective view of the base and buoyant members taken from FIG. 1A and shown on an enlarged scale;

FIG. 3A is an exploded view of the base and buoyant members;

FIG. 3B is an isolated view on an enlarged scale of a transmitter assembly taken from FIG. 3A;

FIG. 4A is another top view of the buoyant member;

FIG. 4B is a sectional view of the buoyant member taken along line 4B—4B of FIG. 4A showing a coupling of the buoyant member to the base;

FIG. 4C is an isolated view of the coupling taken from FIG. 4B and shown on an enlarged scale with the coupling at a disengaged configuration;

FIG. 4D is a isolated view of the coupling taken from FIG. 4B and shown on an enlarged scale with the coupling at an engaged configuration;

DESCRIPTION OF THE PREFERRED EMBODIMENT

Figure 2A:
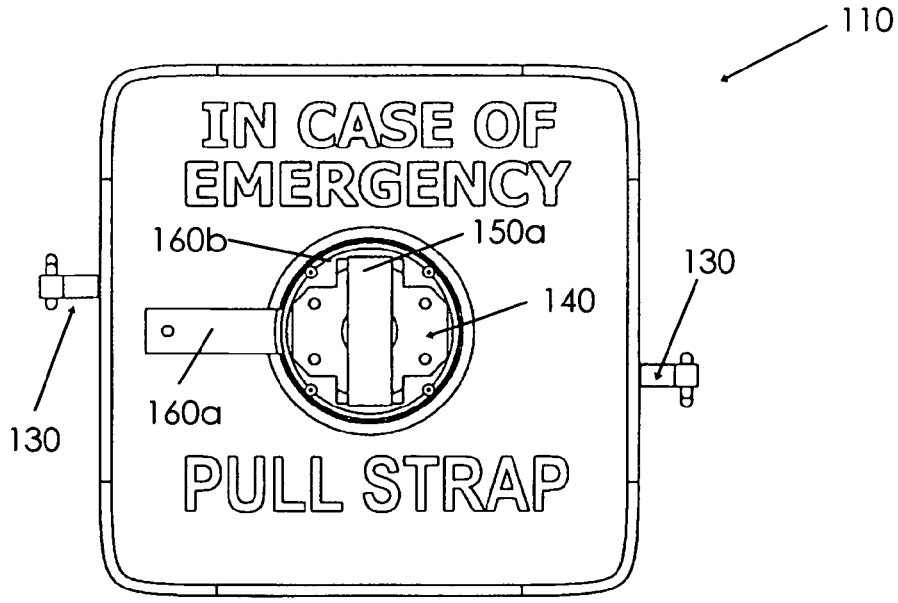
FIG. 2A is a top view of the buoyant member.
Figure 2B:
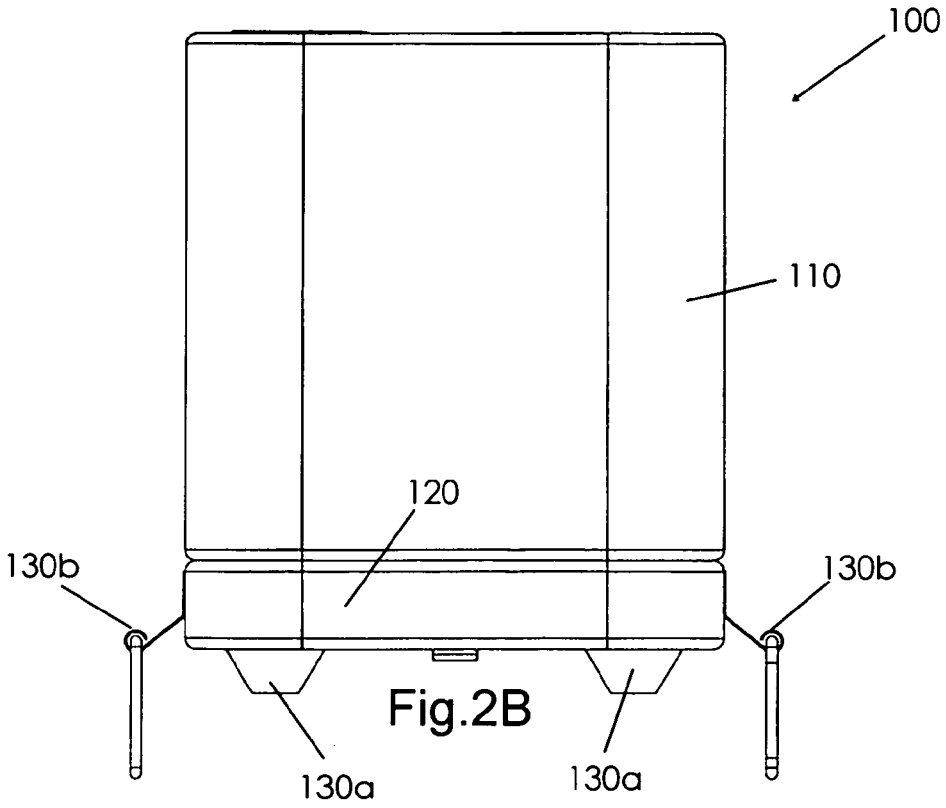
FIG. 2B is a side view of the buoyant member.

A water safety device according to the present invention will now be described in detail with reference to FIGS. 1 through 7 of the accompanying drawings. More particularly, a safety device 100 for use in a body of water 10 having a water surface 12 and a floor surface 14 includes a buoyant member 110 releasably coupled to a base 120. The body of water 10 is preferably contained in a pool 2, and the floor surface 14 is preferably a floor surface of the pool 2.

Means 130 are included for positioning the base 120 beneath the water surface 12 and preferably adjacent the floor surface 14. The means 130 preferably includes a ballast 130*a* (FIG. 2B) or a hook 130*b* (FIG. 2B) attached to the base 120 although a suction cup, bolts or other anchors, an adhesive, or any combination of the aforementioned means would also be suitable. The buoyant member 110 is coupled to the base 120 such that the buoyant member 110 is also located beneath the water surface 12 when the buoyant member 110 is coupled to the base 120.

The buoyant member 110 preferably defines a substantially vertical channel 112 having a channel surface 112*a*, and a coupling 140 is positioned adjacent a lower end of the channel 112 for releasably attaching the buoyant member 110 to the base 120. The coupling 140 preferably includes a pair of opposed attachment members 142 and a compression collar 146.

As best shown in FIGS. 4A to 4D, each attachment member 142 has a first end 142*a* attached to the buoyant member 110 and a second end 142*b* releasably coupled to the base 120, and each attachment member 142 has a compression arm 144 extending downwardly therefrom. The first ends 142*a* are preferably attached to the channel surface 112*a* to make the coupling 140 accessible from the channel 112. The compression collar 146 is adjacent the compression arms 144 for movement between a first configuration 146*a* surrounding the compression arms 144 and a second configuration 146*b* bearing against the compression arms 144.

A release member 150 (FIG. 3A) is accessible inside the channel 112 and is attached to the coupling 140 for manipulating the coupling 140 to selectively release the buoyant member 110 from the base 120 (FIG. 4D). The release member 150 is preferably a release strap 150*a* (FIGS. 3A and 4B) attached to the compression collar 146 for moving the compression collar 146 from the first configuration 146*a* to the second configuration 146*b* when the release strap 150*a* is pulled by a user.

A wrist strap 160 has an end 160*a* attachable to the buoyant member 110, and the wrist strap 160 forms a loop 160*b* for attachment to a user's wrist (FIG. 3A). The loop 160*b* is positionable adjacent the channel surface 112*a* and may be selectively retained adjacent the channel surface 112*a* by a retaining member 164 (FIG. 4B). The retaining member 164 extends from the base 120 along the channel surface 112*a* for retaining the loop 160*b* adjacent the channel surface 112*a* when the buoyant member 110 is coupled to the base 120 and for releasing the loop 160*b* from adjacent the channel surface 112*a* when the buoyant member 110 is released from the base 120.

Figure 5:
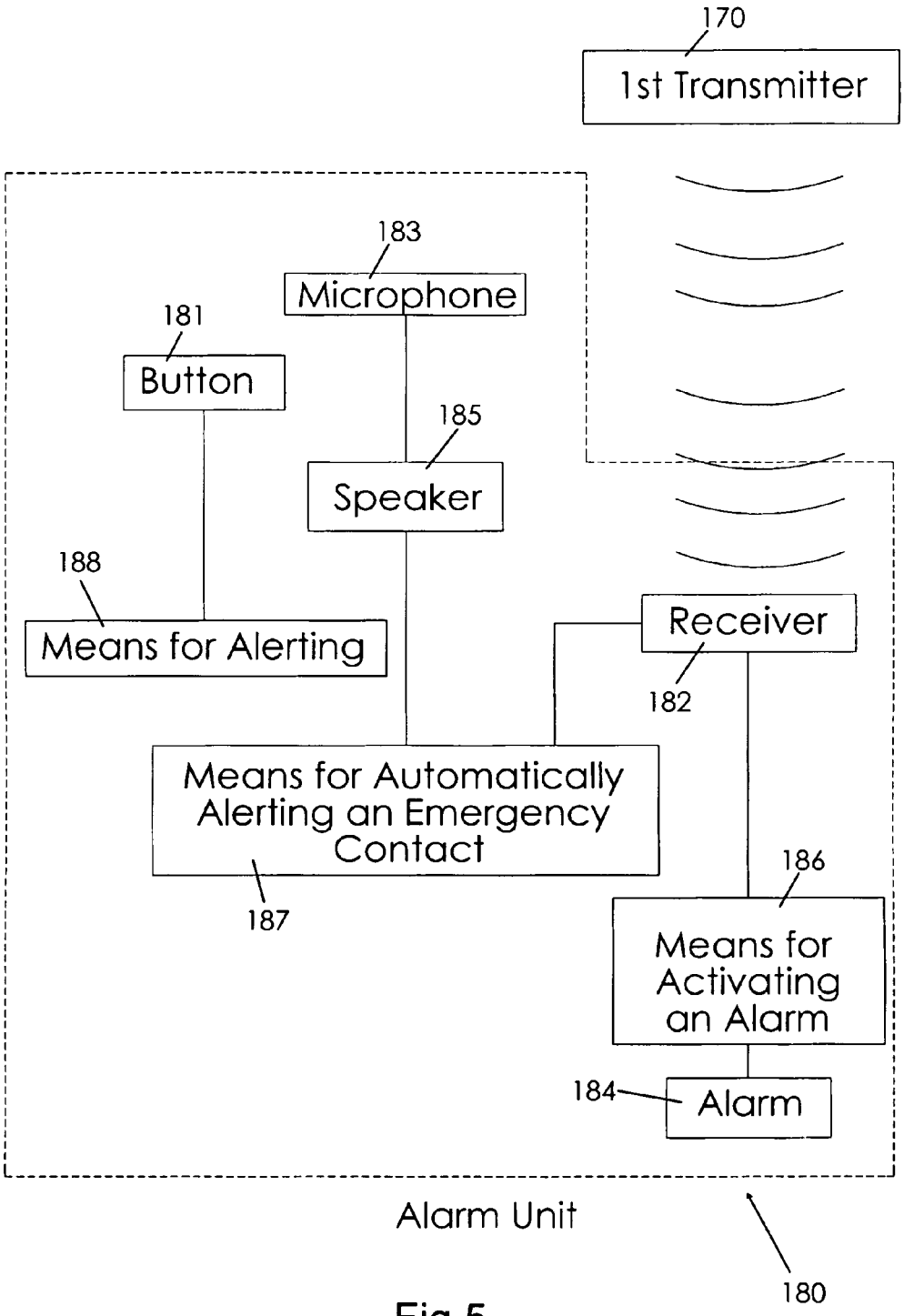
FIG. 5 is a block diagram showing the components of the alarm unit of the present invention.

A first transmitter 170 is connected to the buoyant member 110 for selectively transmitting a signal (FIG. 3A), and an alarm unit 180 having a receiver 182 and an alarm 184 is remote from the first transmitter 170 (FIG. 5). Although not essential, the first transmitter 170 may be secured within a transmitter case 171 with lid 171*a*. A sensor 172 is in communication with the first transmitter 170 for detecting a release of the buoyant member 110 from the base 120 and actuating the first transmitter 170 when the buoyant member 110 is released from the base 120 (FIG. 3A).

The alarm unit 180 preferably also includes means 186 for activating the alarm 184 when the receiver 182 receives a signal from the first transmitter 170, means 187 for automatically alerting an emergency contact when the alarm unit receiver 182 receives the signal, a button 181, means 188 for alerting the emergency contact when the button 181 is activated, and a speaker 185 and a microphone 183 for allowing communication with the emergency contact after the emergency contact has been alerted (FIG. 5).

The means 186 for activating the alarm 184 preferably includes circuitry or a CPU with programming electrically connected to the receiver 182 and the alarm 184 (FIG. 5).

Figure 6A:
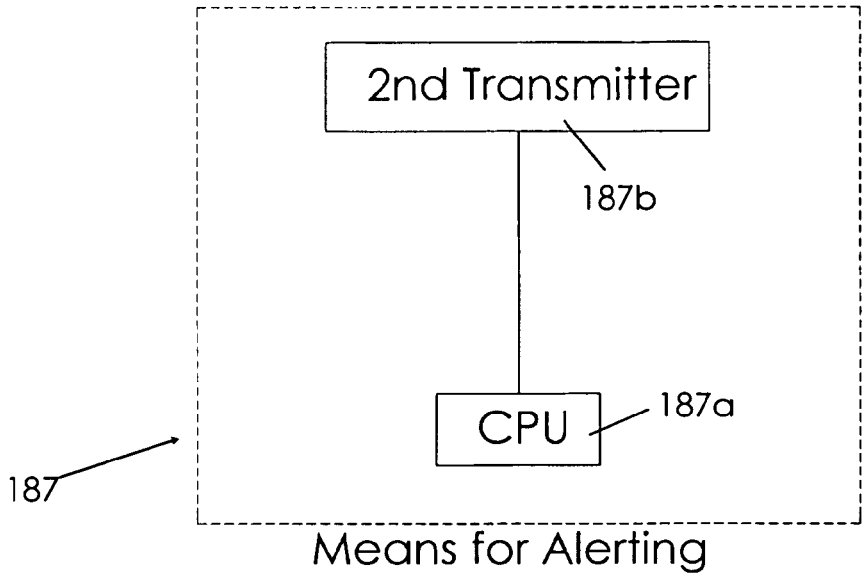
FIG. 6*a* is a block diagram illustrating one means in the alarm unit for contacting an emergency contact.

As more particularly shown in FIG. 6*a*, the means 187 for automatically alerting the emergency contact preferably includes circuitry or a CPU 187*a* with programming electrically connected to the receiver 182 and a second transmitter 187*b*. The circuitry or the CPU 187*a* with programming causes the second transmitter 187*b* to transmit a signal (such as a cellular signal, a signal through a telephone line, a signal over the internet, etc.) when the alarm unit receiver 182 receives the signal from the first transmitter 170.

Figure 6B:
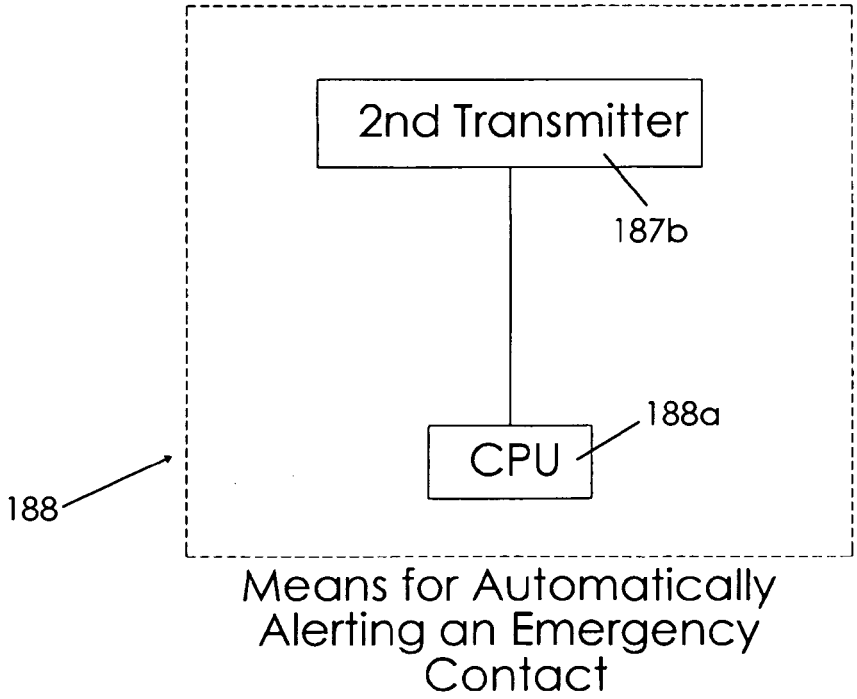
FIG. 6*b* is a block diagram illustrating another means in the alarm unit for contacting an emergency contact.

As more particularly shown in FIG. 6*b*, the means 188 for alerting the emergency contact preferably includes circuitry or a CPU 188*a* with programming electrically connected to the button 181 and the second transmitter 187*b*. The circuitry or the CPU 188*a* with programming causes the second transmitter 187*b* to transmit a signal (such as a cellular signal, a signal through a telephone line, a signal over the internet, etc.) when the button 181 is activated.

In use, the base 120 is positioned beneath the water surface 12 by the means 130. The buoyant member 110 is then coupled to the base 120 such that the buoyant member 110 is also located beneath the water surface 12. This is preferably done by moving the compression collar 146 to the first configuration 146*a* and positioning the second ends 142*b* of the attachment members 142 to engage the base 110.

To use the safety device 100, a user dives to the buoyant member 110, reaches inside the vertical channel 112, and pulls the release strap 150*a*. Pulling the release strap 150*a* moves the compression collar 146 from the first configuration 146*a* to the second configuration 146*b*, causing the second ends 142*b* of the attachment members to release the base 120.

The buoyancy of the buoyant member 110 causes the buoyant member 110 to rise away from the base 120 and to reach the water surface 12. The sensor 172 detects the release of the buoyant member 110 from the base 120 and actuates the first transmitter 170, causing the first transmitter 170 to send a signal. As the buoyant member 110 separates from the base 120, the wrist strap 160 is separated from the retaining member 164. Depending on the type of loop 160*b*, the wrist strap 160 may then tighten around the user's wrist, ensuring that he gets carried to the water surface 12 along with the buoyant member 110.

When the alarm unit receiver 182 receives the signal from the first transmitter 170, the means 186 (preferably the attached circuitry or CPU with programming) activate the alarm 184. The means 187 (preferably the appropriate circuitry or programming in the CPU and the second transmitter) automatically alert the predetermined emergency contact. More particularly, the circuitry or programming in the CPU preferably cause the second transmitter to transmit a signal to the emergency contact when the alarm unit receiver 182 receives the signal from the first transmitter 170. Once the emergency contact has been alerted, the microphone 183 and the speaker 185 allow communication with the emergency contact.

The means 188 for alerting the emergency contact when the button 181 is activated may be used independently of the release of the buoyant member 110 from the base 120. In other words, someone may activate the button 181, and the circuitry or programming in the CPU then causes the second transmitter 187*b* to transmit a signal to the emergency contact. This allows someone standing near the alarm unit 180 to quickly alert the emergency contact.

It is understood that while certain forms of this invention have been illustrated and described, it is not limited thereto except insofar as such limitations are included in the following claims and allowable functional equivalents thereof.

What is claimed is:

1. A safety device for use in a pool, comprising:

a buoyant member;

a base releasable coupled to said buoyant member;

means for positioning said base adjacent a floor surface of the pool;

a first transmitter connected to said buoyant member for selectively transmitting a signal;

a sensor for detecting a release of said buoyant member from said base, said sensor being in communication with said first transmitter for actuating said first transmitter when said buoyant member is released from said base; and an alarm unit remote from said first transmitter, said alarm unit having a receiver for receiving said signal, an alarm, and means for activating said alarm when said receiver receives said signal.

2. The safety device as in claim 1, wherein said buoyant member is located beneath a water surface of the pool when coupled to said base.

3. The safety device as in claim 1, wherein said alarm unit includes means for automatically alerting an emergency contact when said alarm unit receiver receives said signal.

4. The safety device as in claim 3, wherein said alarm unit includes a speaker and a microphone for allowing communication with the emergency contact after the emergency contact has been alerted.

5. The safety device as in claim 4, wherein said alarm unit includes:

a button; and means for alerting the emergency contact when said button is activated.

6. The safety device as in claim 1, wherein said alarm unit includes:

means for alerting an emergency contact; and a button for actuating said means for alerting an emergency contact.

7. The safety device as in claim 1, further comprising:

a pair of opposed attachment members, each said attachment member having a first end attached to said buoyant member and a second end releasably coupled to said base, each said attachment member having a compression arm extending downwardly therefrom;

a compression collar adjacent said compression arms for movement between a first configuration surrounding said compression arms and a second configuration bearing against said compression arms for releasing said second ends of said attachment members from said base; and a release strap attached to said compression collar for moving said compression collar from said first configuration to said second configuration when said release strap is pulled by a user.

8. The safety device as in claim 7, wherein:

said buoyant member defines a substantially vertical channel having a channel surface;

said first ends of said opposed attachment members are attached to said channel surface; and said release strap is positioned in said channel.

9. The safety device as in claim 8, further comprising:

a wrist strap having an end attachable to said buoyant member, said wrist strap forming a loop for attachment to a user's wrist, said loop being positionable adjacent said channel surface; and a retaining member extending from said base along said channel surface for retaining said loop adjacent said channel surface when said buoyant member is coupled to said base and releasing said loop from adjacent said channel surface when said buoyant member is released from said base.

10. The safety device as in claim 1, wherein said means for positioning said base adjacent a floor surface of the pool is a ballast.

11. The safety device as in claim 1, wherein said means for positioning said base adjacent a floor surface is a hook attached to said base.

12. A safety device for use in a body of water having a water surface, comprising:

a base;

means for positioning said base beneath the water surface;

a buoyant member releasable attached to said base, said buoyant member being located beneath the water surface when attached to said base, said buoyant member defining a substantially vertical channel;

a coupling positioned adjacent a lower end of said channel for releasably attaching said buoyant member to said base;

a release member attached to said coupling and being accessible inside said channel for manipulating said coupling, whereby selectively releasing said buoyant member from said base;

a first transmitter connected to said buoyant member for selectively transmitting a signal;

a sensor for detecting a release of said buoyant member from said base, said sensor being in communication with said first transmitter for actuating said first transmitter when said buoyant member is released from said base; and an alarm unit remote from said first transmitter, said alarm unit having a receiver for receiving said signal, an alarm, and means for activating said alarm when said receiver receives said signal.

13. The safety device as in claim 12, wherein said alarm unit includes means for automatically alerting an emergency contact when said alarm unit receiver receives said signal.

14. The safety device as in claim 13, wherein said alarm unit includes a speaker and a microphone for allowing communication with the emergency contact after the emergency contact has been alerted.

15. The safety device as in claim 12, wherein:

said coupling comprises:

a pair of opposed attachment members, each said attachment member having a first end attached to said buoyant member and a second end releasably coupled to said base, each said attachment member having a compression arm extending downwardly therefrom;

a compression collar adjacent said compression arms for movement between a first configuration surrounding said compression arms and a second configuration bearing against said compression arms for releasing said second ends of said attachment members from said base; and said release member is attached to said compression collar for selectively moving said compression collar from said first configuration to said second configuration.

16. The safety device as in claim 15, further comprising:

means for automatically alerting an emergency contact when said alarm unit receives said signal.

17. The safety device as in claim 12, wherein said channel has a channel surface, said safety device further comprising:

a wrist strap having an end attachable to said buoyant member, said wrist strap forming a loop for attachment to a user's wrist, said loop being positionable adjacent said channel surface; and a retaining member extending from said base along said channel surface for retaining said loop adjacent said channel surface when said buoyant member is coupled to said base and releasing said loop from adjacent said channel surface when said buoyant member is released from said base.

* * * * *